United States Patent [19]

Gano et al.

[11] Patent Number: 4,702,320

[45] Date of Patent: Oct. 27, 1987

[54] METHOD AND SYSTEM FOR ATTACHING AND REMOVING EQUIPMENT FROM A WELLHEAD

[75] Inventors: John C. Gano, Carrollton; Kenneth L. Schwendemann, Lewisville; Timothy J. Noack, Grapevine; Craig W. Godfrey, Carrollton, all of Tex.

[73] Assignee: Otis Engineering Corporation, Dallas, Tex.

[21] Appl. No.: 891,391

[22] Filed: Jul. 31, 1986

[51] Int. Cl.[4] ..... E21B 33/035; E21B 33/038

[52] U.S. Cl. ..... 166/343; 166/341; 166/355

[58] Field of Search ..... 166/338–343, 166/345, 346, 350, 355, 351, 360, 368, 365, 367, 359

[56] References Cited

U.S. PATENT DOCUMENTS

| | | | |
|---|---|---|---|
| 3,021,909 | 2/1962 | Postlewaite | 166/343 |
| 3,532,162 | 10/1970 | Fischer | 166/360 |
| 3,675,713 | 7/1972 | Watkins | 166/340 |
| 4,046,192 | 9/1977 | Darnborough et al. | 166/341 |
| 4,077,472 | 3/1978 | Gano | 166/315 |
| 4,175,620 | 11/1979 | Nolan, Jr. et al. | 166/343 |
| 4,176,986 | 12/1979 | Taft et al. | 405/211 |
| 4,191,256 | 3/1980 | Croy et al. | 166/343 |
| 4,544,036 | 10/1985 | Saliger | 166/341 |
| 4,570,716 | 2/1986 | Genini et al. | 166/346 |
| 4,620,818 | 11/1986 | Langner | 166/343 |

FOREIGN PATENT DOCUMENTS

| | | | |
|---|---|---|---|
| 2097449 | 11/1982 | United Kingdom | 166/350 |

OTHER PUBLICATIONS

Walther, Ed, "Templates, Trees and Controls", Petroleum Engineer International, Dec. 1978, pp. 26–40.

Crawford, Diane, "Deepwater Tools Work Against Odds", Offshore, Jan. 1980, pp. 49–53.

*Primary Examiner*—Stephen J. Novosad
*Assistant Examiner*—Bruce M. Kisliuk
*Attorney, Agent, or Firm*—Vinson & Elkins

[57] ABSTRACT

A system and method for attaching and removing equipment from a subsea wellhead in which equipment is lowered and raised on a flexible riser pipe, cables extend from the equipment to the wellhead and are winched in and out to control movement of the equipment adjacent the wellhead. While the cables are being winched in or out, the cables are maintained in tension by the cable reel or a motion compensator, between the equipment and riser pipe, permits the riser pipe to reciprocate vertically with the vessel in response to wave action, while the equipment is insulated from this action during engagement and disengagement with the wellhead. The equipment may include a guide frame, which may be made in two pieces, so that the upper section of the guide frame together with a riser pipe connector, may be released from the remainder of the frame and connector and lifted off by the riser pipe or by buoyancy means. The cable winch system may thereafter be used to reconnect the riser pipe lower connector to the remainder of the equipment. Whether a one or two piece frame is used, after the frame is landed on the wellhead with the equipment spaced from the wellhead, the equipment is preferably lowered into engagement with the wellhead. The motion compensator between the frame and riser pipe may provide this function.

36 Claims, 24 Drawing Figures

METHOD AND SYSTEM FOR ATTACHING AND REMOVING EQUIPMENT FROM A WELLHEAD

This invention relates to methods and systems for attaching and removing equipment from a subsea wellhead.

Equipment such as christmas trees, blowout preventers, test trees and the like, are conventionally run on a rigid riser pipe and guided by guidelines extending to the drill ship. Motion compensation to prevent heave of the vessel due to wave action being transmitted to the equipment is provided by motion or heave compensation equipment on the vessel. Completions of this type require the use of a drilling vessel which has a very high per day charge for its use. The high cost of this type of completion inhibits early completion of the initial wells in a field and production of these wells to storage vessels and the like.

An object of this invention is to provide a completion system and method which can be carried out utilizing a small vessel, such as a diver support vessel, to permit early completion and production from subsea wells.

Another object is to provide a method and system for landing equipment on a subsea wellhead in which motion compensation is provided between the riser pipe and the equipment to be landed.

Another object is to provide a method and system for landing equipment on a subsea wellhead in which draw down means is employed between the wellhead and the equipment to draw the equipment down into engagement with the wellhead.

Another object is to provide a method and system as in the preceding object, in which the equipment carries a frame which is first drawn into engagement with the wellhead and thereafter the equipment is moved downwardly and connects with the wellhead.

Another object is to provide a method and system for landing equipment on a subsea well in which the equipment includes a frame which is drawn down into engagement with the wellhead by draw down means, such as cables taken up by winches, in which a motion compensator is provided between the riser pipe and frame, and after the frame is landed the riser pipe, which is flexible, is paid out and the equipment is lowered into engagement with and latched to the wellhead.

Another object is to provide a method and system as in the preceding object in which the motion compensation means also is the means for raising and lowering the equipment relative to the frame for connection and latching to the wellhead.

Another object is to provide a frame with well equipment supported thereon by a two-way motor, such as a double acting cylinder and piston, in which the frame may first be landed on the wellhead and thereafter the motor utilized to move the equipment into engagement with the wellhead.

Another object is to provide a method and system as in the preceding object in which the motor may disengage the equipment from the wellhead after it has been unlatched and before the equipment and supporting frame are removed from the wellhead.

Another object is to provide a method and system, as in the preceding two objects, in which the equipment and frame may be provided in two parts with the upper frame carrying the lower riser connector and the lower frame carrying the remainder of the equipment so that an emergency disconnect can be made between the lower riser connector and the equipment.

Another object is to provide a method and system for landing and removing equipment from a wellhead in which buoyancy means is attached to the equipment to permit raising the equipment and draw down cable winches, carrying cables connected between the equipment and the wellhead, provide for lowering of the equipment by taking in the cables.

Another object is to provide a method and system as in the preceding object in which the equipment is suspended from a flexible riser pipe and includes a lower riser connector which is attached to the buoyancy means to permit emergency disconnect of the lower riser connector from the remainder of the equipment and reattachment of the connector by attachment of and reeling in the cable winches.

Another object is to provide a system and method for landing and removing equipment and a flexible riser pipe from a wellhead in which movement of the equipment between the wellhead and a position adjacent the wellhead is controlled by cables between the wellhead and equipment, and the reel for the riser pipe and in which the cables are maintained in tension during such movement.

Another object is to provide a system and method as in the preceding object wherein tension is maintained by controlling rotation of the riser pipe reel.

Another object is to provide a system and method as in the preceding object wherein motion compensation between said equipment and riser pipe reel is provided by controlling rotation of the reel as equipment is moved between said position and the surface.

Another object is to provide a system and method as in the preceding object in which the equipment includes a frame which is first landed by engaging extensible motors with the wellhead, the riser pipe is then reeled out to provide slack, and the frame is then pulled down to full landed position by the cables being maintained in tension and the extensible motors retracted.

Other objects, features and advantages of the invention will be apparent from the drawings, the specification and the claims.

In the drawings wherein illustrative embodiments of this invention are shown and wherein like numerals indicate like parts:

Figure 1:
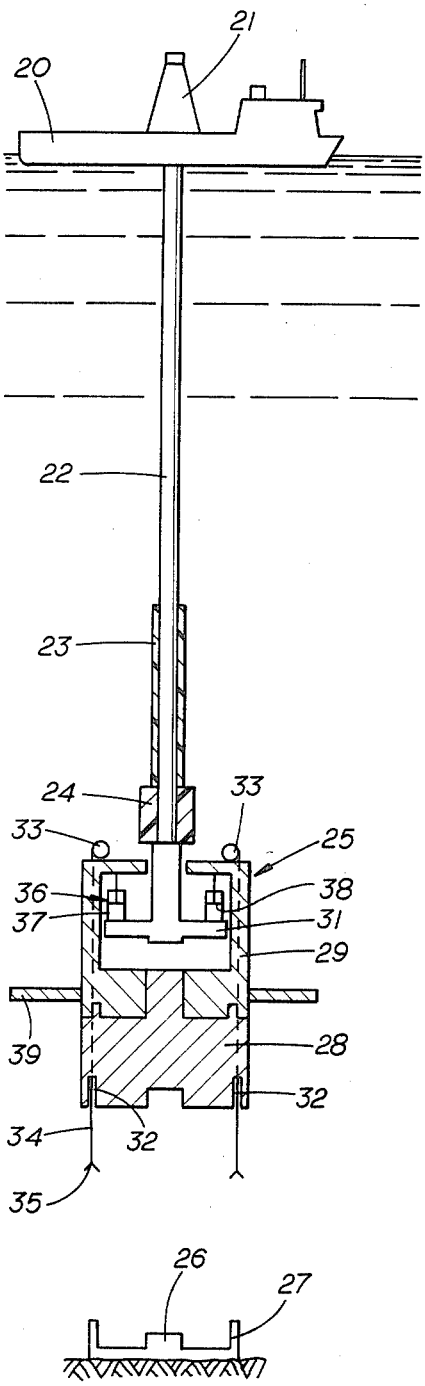
FIG. 1 is a diagrammatic view, partly in elevation and partly in section, illustrating the first step in carrying out one form of this invention utilizing a flexible riser pipe.
Figure 2:
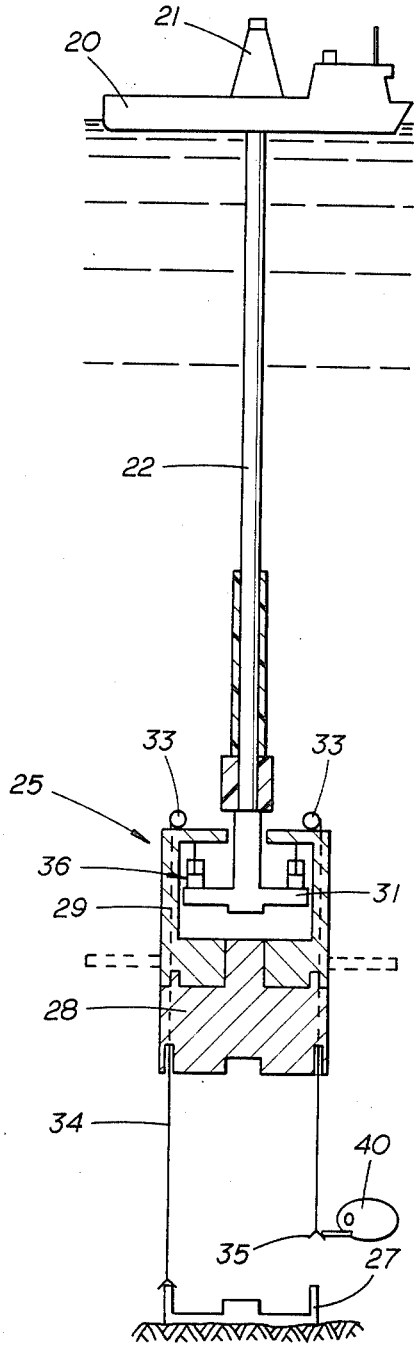
FIG. 2 is a view similar to FIG. 1, illustrating attachment of the cables extending down from the equipment to the guide base at the wellhead.

Referring to FIG. 1, a diver support vessel 20 is provided with a conventional support and reel assembly 21 from which there depends the flexible riser 22.

Flotation attachments 23 and 24 may be provided on the lower end of the riser pipe to provide buoyancy if desired. The equipment to be landed is indicated generally at 25 and is suspended on the lower end of the flexible riser 22.

The equipment 25 is to be landed on a subsea wellhead 26, having a plurality of upstanding guides 27 for aligning the equipment with the subsea wellhead.

Preferably, the equipment includes a lower frame and equipment 28, such as a christmas tree, and an upper frame 29 and associated equipment such as the riser connector 31.

The equipment carried by the lower frame may be fixed to the frame or may be slidable on the frame and reciprocated by a motor between the frame and equipment or by a motor carried by the upper frame, as will hereinafter appear.

The lower frame is provided with guide means 32, which cooperate with the guides 27 on the wellhead 26 to align the lower equipment frame with the wellhead.

A plurality of draw down means are carried by one of the equipment frame means and the wellhead means. Preferably, the draw down means is provided by cable winches 33 having cables 34 thereon with an attachment device 35 at the lower end of the cable for attachment to the guides 27 on the subsea wellhead 26. Preferably, the cables extend through the guides 32 on the lower frame 28 so that take up of the cables after attachment to the wellhead will guide the equipment frame into proper position for interengagement of the guides 27 and 32 to properly align the equipment frame with the wellhead.

The winches 33 are preferably hydraulically controlled by lines (not shown) extending to the vessel 20. Preferably, surface controls will include a means for tactile feed back sensing of the tension in the cables.

The upper equipment section provided by the riser connector 31 is slidably supported on the upper frame means 29.

A yieldable urging means is connected between the upper equipment frame 29 and the upper equipment section 31 to yieldably urge the frame upwardly with a force which is at least equal to the downward force exerted by the frame means 28 and 29. Preferably, the force equals the downward force exerted by the frame means plus the tension in the cables after attachment of the cables to the guide posts. Preferably, this upward urging means is provided by a heave compensator indicated generally at 36. As will appear more in detail hereinafter, the compensator 36 includes the cylinder 37 and piston 38. The piston is carried by the upper equipment frame 29. Thus, by providing a resilient load upward on the piston 38, the frame and equipment is supported. This resilient load is preferably provided through a hydraulic system with an associated accumulator, as more fully described hereinafter, to provide the desired upward force.

The fluid in the cylinders 37 should be connected to a source providing resiliency such as an accumulator with a gas charge therein so that when the frame and equipment is held against upward movement by the cables 34, the riser connector 31 can move upwardly with upward heave of the vessel 20 and, in doing so, displace fluid into the accumulator. When the vessel moves downwardly with wave action, the accumulator should introduce additional fluid into the cylinder below the piston 38 to maintain the desired lifting force on the frame and equipment. If fluid is present in the cylinder above the piston 38, it should be free to move in and out of the cylinder with the heave of the vessel 20.

In practicing the method utilizing equipment shown in FIG. 1, the equipment is positioned over the wellhead, as shown in FIG. 1. Then, a diver or a remote operated vehicle 40 is used to attach the cable attachments 35 to the guides 27 on the subsea wellhead. After the cables are attached, the cable winches are operated to take in the cables and draw the equipment downwardly. Simultaneously, the upward urging means provided by the heave compensator 36 will be providing an upward force supporting the equipment 25 from the riser 22. The operator pays out the riser 22 from the vessel 20, while simultaneously taking in the cables 34 to preferably maintain the pistons 38 approximately in the mid-position in a cylinder 37. The heave compensator 36 permits vertical movement of the flexible riser with heave action on the vessel 20 without transmitting this action to the frame and equipment 28 and 29.

Figure 3:
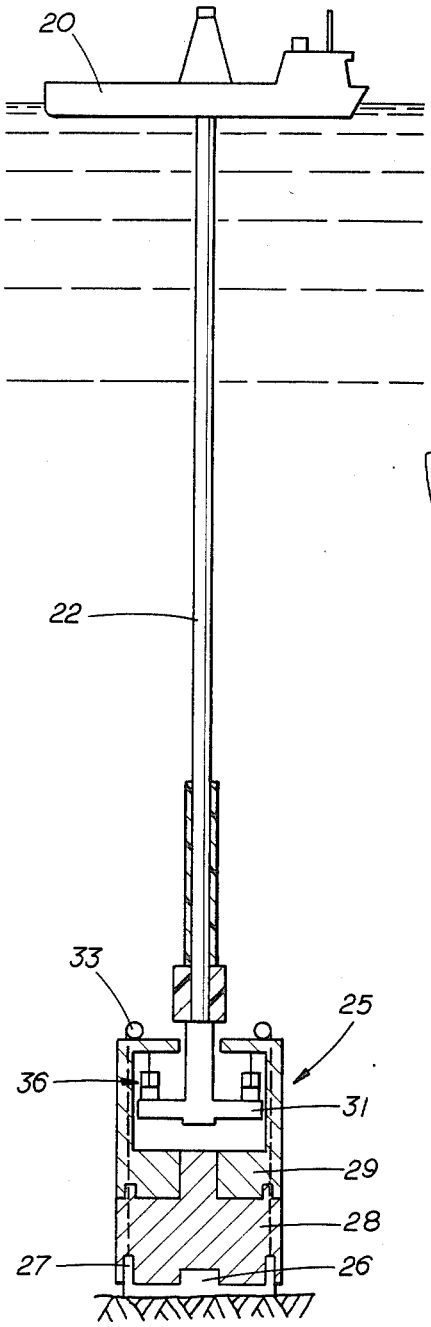
FIG. 3 is a view similar to FIG. 2, illustrating the equipment being drawn down to the wellhead with motion compensation provided between the equipment and the flexible riser pipe.

As shown in FIG. 3, the flexible riser 22 is paid out from the vessel 20 and the cables 34 are taken in by the winches 33 until the equipment package and its frame is landed on the wellhead 26.

Figure 4:
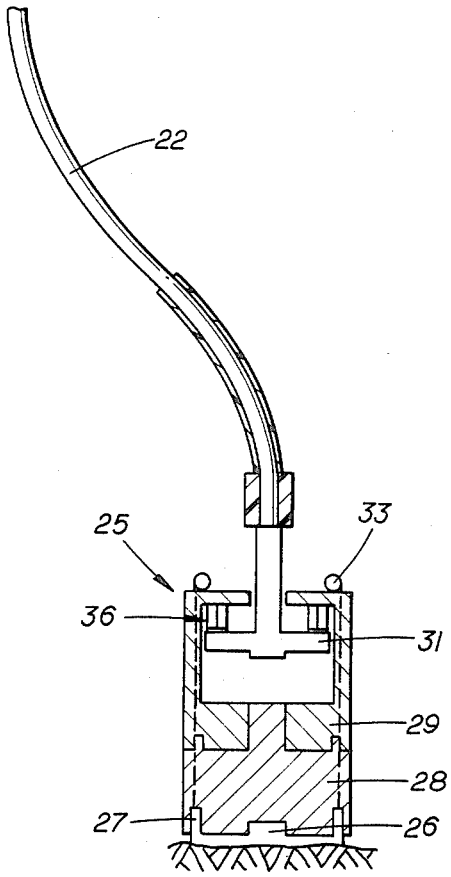
FIG. 4 is a view similar to FIG. 3, illustrating the equipment as having been landed on the wellhead and the lower end of the flexible riser pipe having been raised by the heave compensation mechanism to provide slack in the riser pipe.

After landing of the package 25, fluid is preferably provided in the cylinders 37 above the piston 38, as shown in FIG. 4, to raise the riser connector 31 and relieve the tension in the flexible hose 22, as further indicated in FIG. 4.

Figure 5:
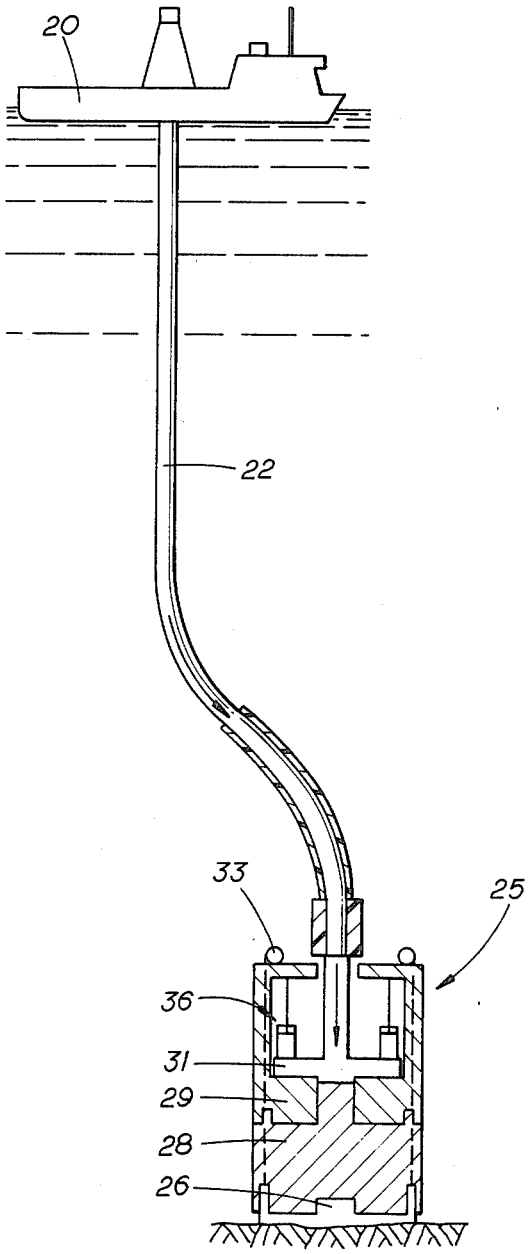
FIG. 5 is a view similar to FIG. 4, illustrating the paying out of the flexible riser by the vessel and the downward movement of the lower end of the flexible riser to permit its connection to the equipment therebelow.

At this time, the vessel 20 will pay out additional length of flexible hose 22 to provide adequate slack for connecting the riser connector 31 to the equipment therebelow. This will allow relative motion to be absorbed by the flexible riser. As indicated in FIG. 5, the riser connector 31 is driven downwardly by pressurizing the cylinder 37 below the piston to drive the riser connector 31 downwardly to a position where it may latch onto the equipment provided by the lower frame and equipment 28.

Figure 6:
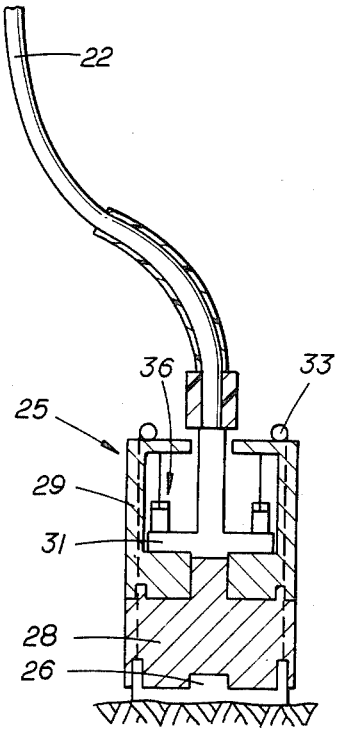
FIG. 6 is a view similar to FIG. 5, illustrating the normal flowing position of the equipment.
Figure 7:
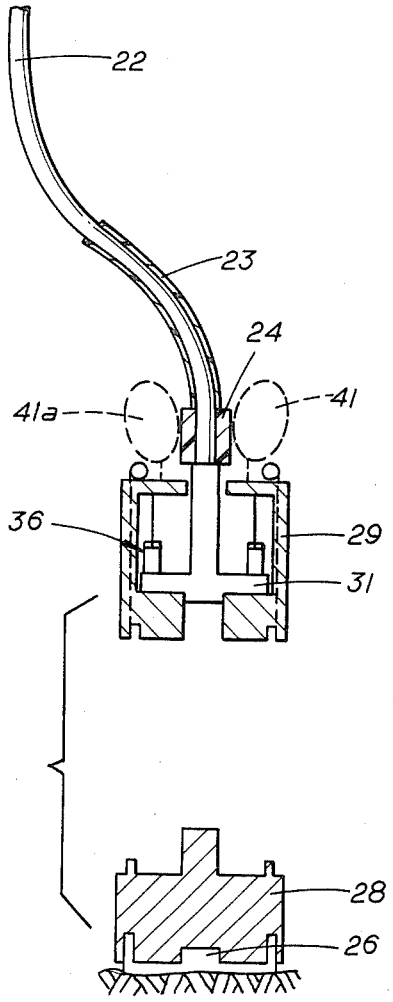
FIG. 7 is a diagrammatic view, partly in elevation and partly in section, illustrating the use of buoyancy means to lift all or a part of the equipment from the wellhead.

FIG. 6 shows the equipment in its final normal flow position after the riser connector has been connected to the equipment.

It is sometimes necessary to disconnect the riser from the wellhead, such as under very heavy weather conditions. In accordance with this invention, inflatable buoyancy modules, shown in dashed lines at 41 and 41*a*, may be inflated to provide an upward force in excess of the downward force (gravity less buoyancy) on the upper equipment section 29 and the riser connector 31 together with the lower section of the flexible riser 22. The flotation attachments 23 and 24 are now effective to provide flotation to the lower section of the flexible riser 22 and the buoyancy means 41 and 41*a*, together with the flotation attachments on the flexible riser, provide an adequate upward force to raise the upper frame 29 and the lower riser connector 31 after the lower riser connector has been disengaged from the equipment section 28.

Figure 8:
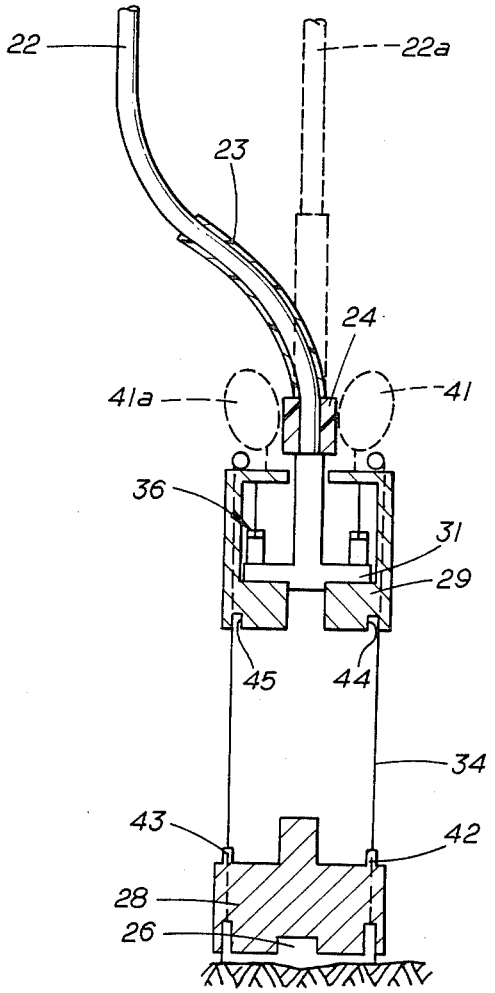
FIG. 8 is a view similar to FIG. 7, illustrating the reconnection of the equipment disconnected in FIG. 7 with the flexible riser shown in solid lines where the equipment is either positively or neutrally buoyant and the flexible riser shown in dashed lines where the disconnected equipment is not buoyant.

FIG. 8 illustrates reconnecting the riser 22 to the equipment package 28. Again, the cables 34 are attached by a diver or remote operated vessel to the wellhead guide posts 27 and extend upwardly through guides 42 and 43 on the upper end of the equipment package. The upper frame 21 has guides 44 and 45, which cooperate with the guides 42 and 43 on the equipment package 28 to align the upper frame 29 with the equipment package 28. Again, the draw down cables 34 extend through the guides 42, 43, 44 and 45 to guide the frame 29 onto the equipment section 28. As the equipment is not suspended from the surface, any heave on the riser pipe 22 has little or no effect on the equipment package and the cables 34 may be taken in against the lifting force provided by the buoyancy means 41 and 41*a* until the upper frame 29 is again supported on the equipment package 28 and the lower riser connector 31 attached to the equipment package. At this time, the buoyancy means 41 and 41*a* may be removed, deflated or ballasted.

The buoyancy means 41 and 41*a* may be provided by any desired means, such as containers open at their lower end, together with the source of gas, such as nitrogen, which may be pumped into the upper end of the vessels to provide buoyancy.

To disconnect the equipment package from the wellhead, the above explained procedure is generally reversed. The cables are connected to the wellhead and the heave compensators are pressurized to provide an upward force between the riser pipe and the equipment package at least as and preferably greater than the total downward force exerted by the equipment package. That is, the gravitational force less the net buoyancy force exerted on the equipment package. Then, the vessel begins to take in the riser pipe until it is placed in tension. Thereafter, the riser pipe is taken in and the cables are paid out until the disconnect from the wellhead is complete and the equipment package is suspended above the wellhead. Thereafter, the cables may be released from the wellhead and the riser pipe reeled in to bring the equipment package to the surface.

A correlation between the handling of the cable winches and the flexible riser reel may be carried out in any desired manner. For instance, the tension in the cables may be measured or sensed and maintained at a desired level. Sensors or limit switches might signal the position of the piston within the cylinder of the motion compensators and these signals are utilized to keep the pistons operating in the mid-section of the cylinders as the winches and reel are operated. Sensors on the winches would indicate the length of the unreeled cable and the tension in the cables. Also, sensors would indicate the tension and length of unreeled riser pipe.

The above disclosure of the system and method for reconnecting after an emergency disconnect (FIG. 8) may be utilized for originally connecting an equipment package to a wellhead.

Preferably, buoyancy tanks 41 and 41*a*, open on bottom, would be connected to the equipment package. The equipment would be run with the tanks filled with sea water so that the equipment would hang with the riser pipe under tension, as shown at 22*a*. With the equipment package near the wellhead, the cables would then be connected to the wellhead guides 27. Then gas would be introduced into the buoyancy tanks until they support the equipment and the cables are in tension. Thereafter, the riser pipe is payed out to provide slack and the cables are reeled in to pull the package into engagement with the wellhead. The buoyancy tanks may then be flooded, if desired.

To remove the equipment from the wellhead, the procedure is reversed. During running and removing equipment in this manner, the equipment package 28 and 29 would be secured together.

Figure 9:
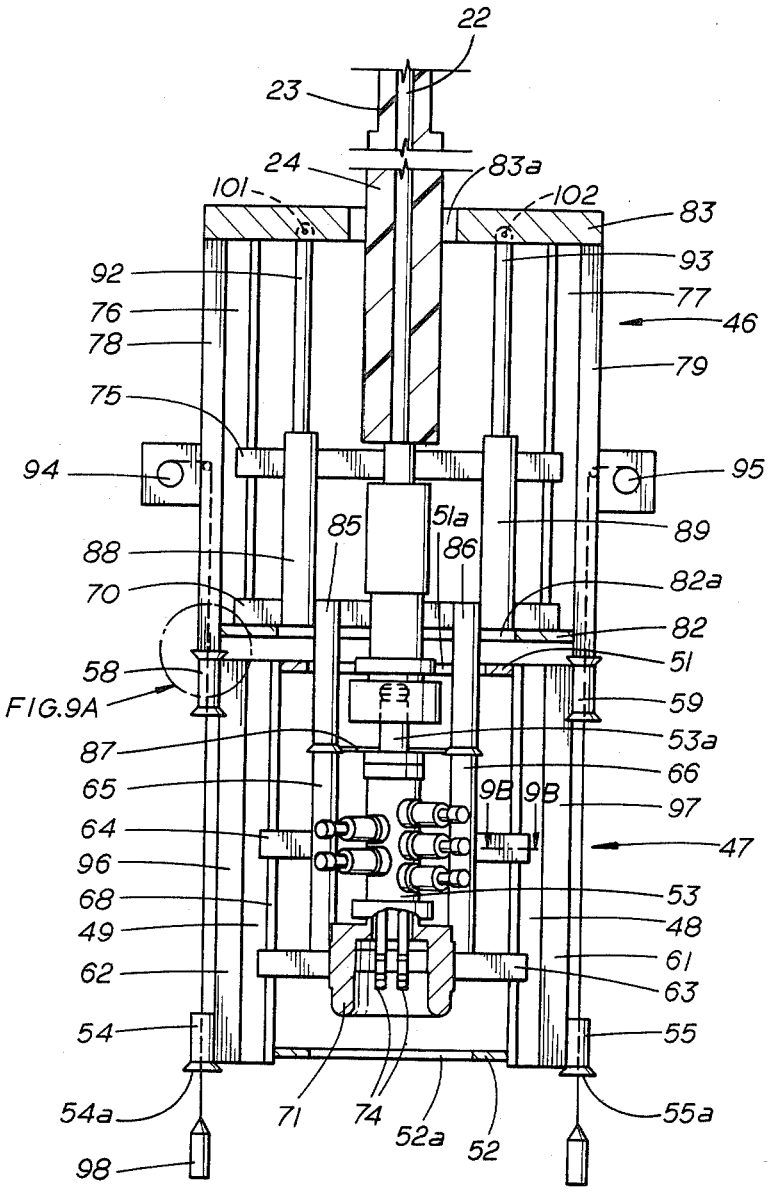
FIG. 9 is a view, partly in elevation and partly in section, illustrating the method and system of this invention in running a christmas tree.
Figure 9A:
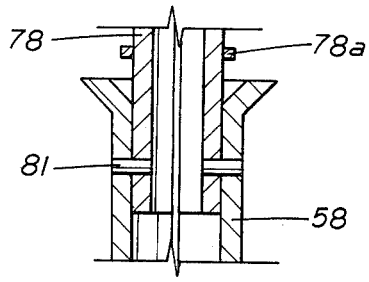
FIG. 9A is a fragmentary section of the equipment shown in the circle 9*a* of FIG. 9.
Figure 9B:
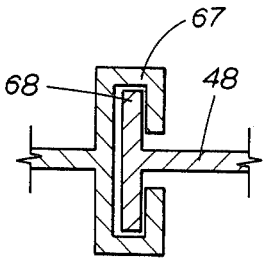
FIG. 9B is a sectional view taken along the lines 9B—9B of FIG. 9.

Referring to FIGS. 9, 9A and 9B, a form of the invention for connecting equipment, such as a christmas tree, to a wellhead is illustrated. The riser pipe 22 with its flotation attachments 23 and 24 will extend upwardly to a vessel such as the diver support vessel 20, as previously explained. The frame includes an upper frame means 46 and a lower frame means 47. Referring first to the lower frame 47, a pair of I-beams provide tracks 48 and 49 spaced by upper and lower plates 51 and 52. These plates may be circular in configuration and have circular holes 51*a* and 52*a* through which equipment, such as the christmas tree 53, may move.

Figure 11:
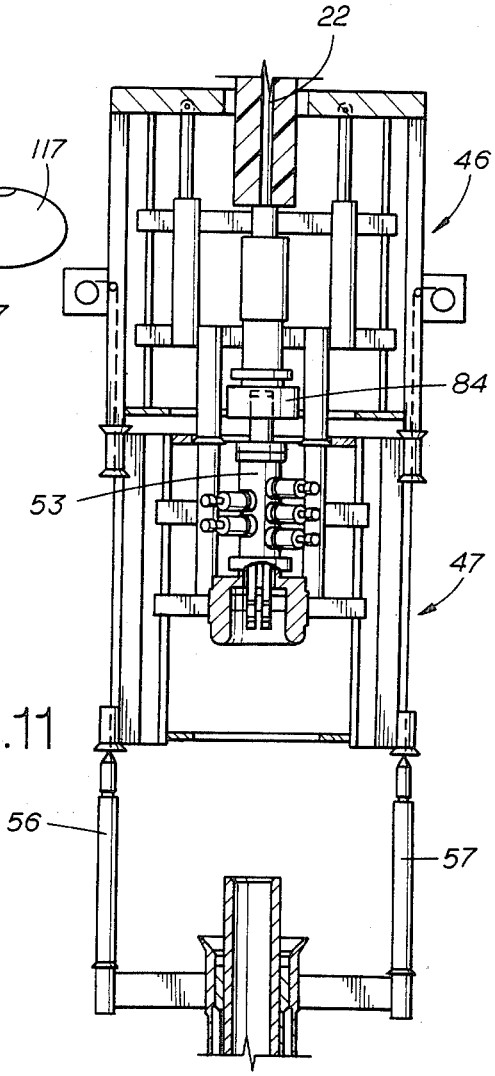
FIG. 11 is a view similar to FIG. 10, illustrating the equipment and its supporting frame being drawn down to a wellhead.
Figure 14:
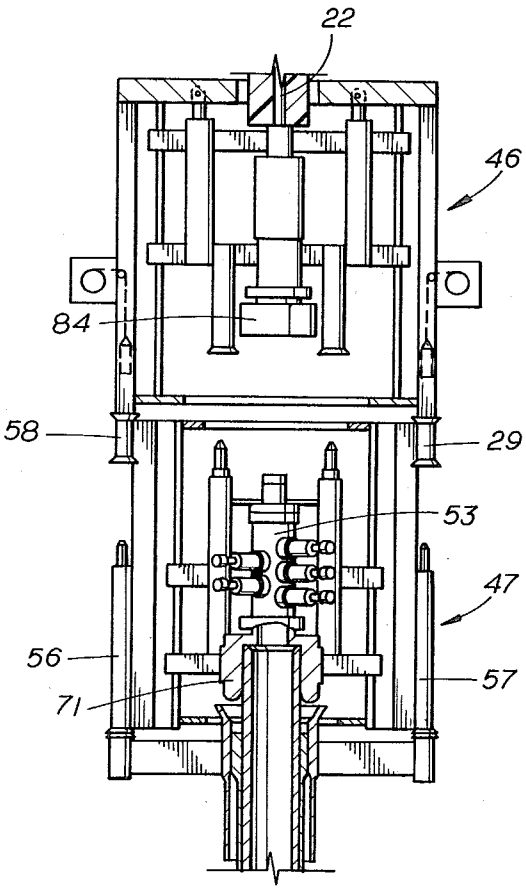
FIG. 14 is a view similar to FIG. 13, illustrating the lower riser connector released from the christmas tree preparatory for an emergency disconnect.

At the lower end of the lower frame, a plurality of guides 54 and 55 are provided. These guides have flared or belled lower extremities 54*a* and 55*a* to assist in guiding the lower frame guides over the upstanding wellhead guide posts 56 and 57 (FIG. 11). At the upper end of the lower frame, a pair of guides 58 and 59 are provided which are flared at their upper and lower extremities to provide guide surfaces. These guides are mounted at the upper end of pipes 61 and 62 which are in turn secured to the track 48–49.

The christmas tree 53 is supported on a slide assembly, which includes the lower cross member 63 and the upper cross member 64, extending between vertical guides 65 and 66. FIG. 9B illustrates that each end of the cross bars 63 and 64 terminate in a C-shape in section end piece 67, which wraps around the cross bar 68 of the T-shaped track 48–49. Vertical movement of the tree 53 is limited by the upper cross bar 64 engaging the plate 51 and the lower cross bar 53 engaging the plate 52.

At the lower end of the christmas tree 53, a conventional hydraulic connector 71 is provided to secure the tree to the subsea wellhead. The two seal subs 74 depending from the tree will seal with tubing hanger (not shown) in the wellhead in the conventional manner.

Upstanding from the tree 53 is the tree mandrel 53*a* for connection to a lower riser connector.

The upper frame 46 includes the upper tracks 76 and 77. Spaced outwardly from the tracks 76 and 77 are structural pipes 78 and 79. The lower end of the pipes 78 and 79 project into the upper guides 58 and 59 and are secured thereto by shear pins 81, as shown in FIG. 9A. A lower plate 82, having a large hole 82*a* therein, interconnects the pipes 78 and 79 and the tracks 76 and 77. At the upper end of the upper frame 46, a circular plate 83 interconnects the two tracks and pipes 76, 77, 78 and 79. The plate has a hole 83*a* for passage of the riser pipe.

An upper equipment section is provided by the lower riser connector 84, which is adapted to be hydraulically secured to the mandrel 53*a* of the tree 53. The lower riser connector 84 is carried on a slide assembly, which includes the upper cross bar 75 and the lower cross bar 70. At their extremities, these cross bars will have the same configuration as shown in FIG. 9B to provide a sliding relationship between the slide assembly and the tracks.

To guide the lower riser connector 84 relative to the tree 53 and its upstanding connector 53*a*, a pair of guide tubes 85 and 86 depend from the lower cross bar 70 and have flared lower ends for engagement with the upstanding guides 65 and 66 on the lower slide assembly. A cross bar 87 braces the lower end of the two guides 85 and 86. A similar brace may be provided at the upper end of guides 65 and 66.

The slide assembly is connected to the upper frame 46 by a means for exerting an upward force between the flexible riser pipe or the lower riser connector 84 and the upper frame 46 and the lower frame 47. Preferably, this is provided by heave compensation cylinders 88 and 89, together with pistons 91, shown in FIG. 18, which are connected to the upper circular support 83 by connecting rods 92 and 93.

The upper frame pipes 78 and 79 carry winches 94 and 95, respectively, from which the cables 96 and 97, respectively, depend. On the bottom of each cable a cable attachment device 98 is provided for attachment to the guides on the wellhead.

While two upper frame pipes 78 and 79 extend between the upper plate 83 and the lower plate 82, it will be understood that additional pipes might be provided circumferentially around the plates 82 and 83, if desired. In like manner, the pipes 61 and 62 of the lower frame section may be augmented by additional pipes extending vertically between the lower plate 52 and the upper plate 51. Likewise, while two are shown, additional slides and tracks might be provided in both the upper and lower sections.

The heave compensation cylinders 88 and 89 are carried by the two slide assembly members 75 and 70. The connecting rods 92 and 93 extending from these cylinders are secured to the upper plate 83 by swivel connections indicated at 101 and 102.

Figure 18:
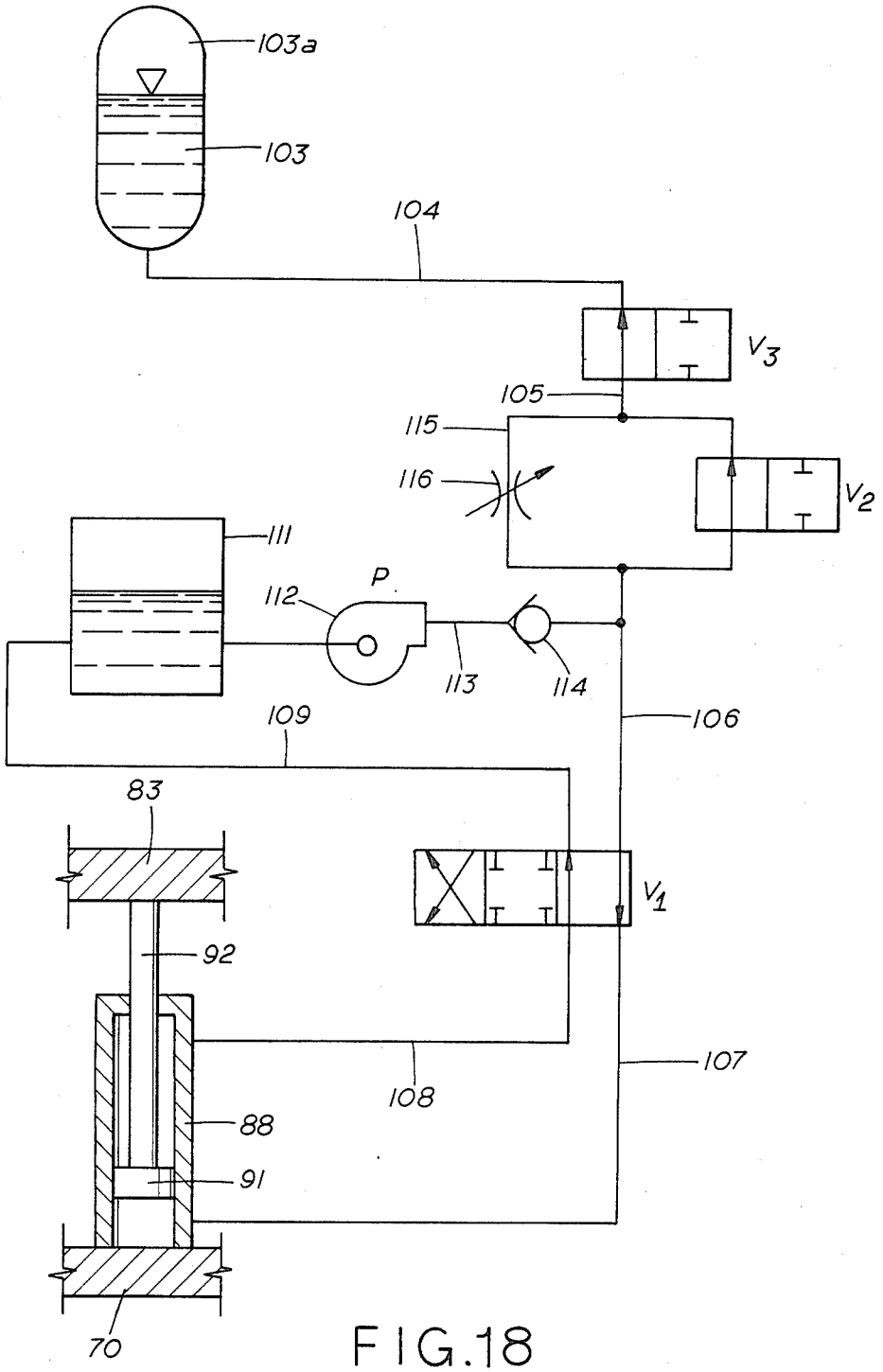
FIG. 18 is a schematic view, including a heave compensation means illustrated partly in section and partly in elevation, of the fluid system for the heave compensation means for raising and lowering the equipment.

Reference is now made to FIG. 18, which illustrates control of the heave compensation cylinders. An accumulator 103, having a gas charge in its dome section 103*a*, is connected to the lower end of the cylinder 88 with the valves $V_1$, $V_2$ and $V_3$ in the position shown by lines 104, 105, 106 and 107. The upper end of the cylinder 88 is connected through lines 108 and 109 to the liquid reservoir 111. Liquid is drawn from the reservoir 111 by pump 112 and introduced through line 113 and check valve 114 to line 106.

A first valve $V_1$ provides for flow between the accumulator 103 and the lower end of the piston 88 with the valve $V_1$ in the position shown. In this position, the lower end of the cylinder 88 is charged with a fluid exerting an upward force which will support the frame, as discussed hereinabove. As the flexible riser pipe 22 reciprocates with wave action effective on the vessel, the cylinders will reciprocate relative to the piston 91, maintaining this desired lifting force while permitting the cylinders and pistons to act as motion compensators. With reciprocation of the piston 91, fluid readily flows through lines 108 to and from the reservoir 111.

The valve $V_1$ has a reversal position to permit the motion compensator to be used to raise and lower the tree 53 and the lower riser connector 84 after the tension has been removed from the flexible riser pipe. Also, $V_1$ has a shutoff position.

When it is desired to use the motion compensator to raise and lower equipment, the valve $V_2$ is moved to the shutoff position and flow passes through the parallel line 115 and the adjustable valve 116, which may be regulated by a diver or remote operated vehicle to operate the motion compensator as a means for raising and lowering equipment.

Finally, the system includes the valve $V_3$ for isolating the accumulator from the system to permit it to be utilized for other purposes, if desired.

Figure 10:
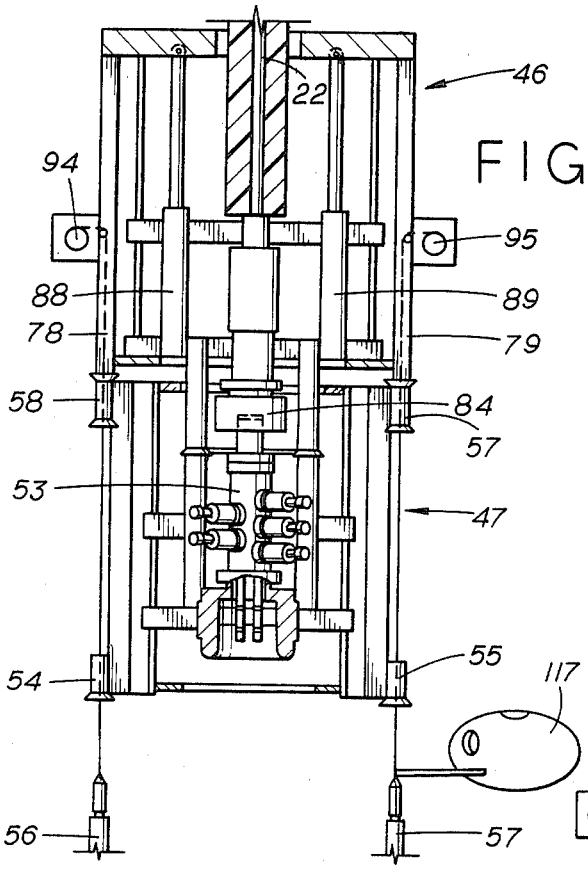
FIG. 10 is a view similar to FIG. 9, showing the cables being attached to the guide posts of a wellhead by a remote operated vehicle.

Use of the apparatus shown in FIG. 9 is illustrated in FIGS. 10 through 17. Referring first to FIG. 10, the diver or remote operated vehicle 117 attaches the cable attachment device 98 at the lower end of each cable to the guide posts 56 and 57. While maintaining the lifting force in the cylinders 88 and 89 to support the upper and lower frame, the flexible riser pipe is lowered and the cables are taken in by the winches 94 and 95. It will be noted that the cables extend downwardly through the structural pipes 78 and 79 of the upper frame and through the upper and lower guides 54, 55, 58 and 59 of the lower frame.

FIG. 11 illustrates the downward movement of the equipment and its supporting frame onto the guides 56 and 57 as the reels take up the cable and the riser pipe is payed out.

Figure 12:
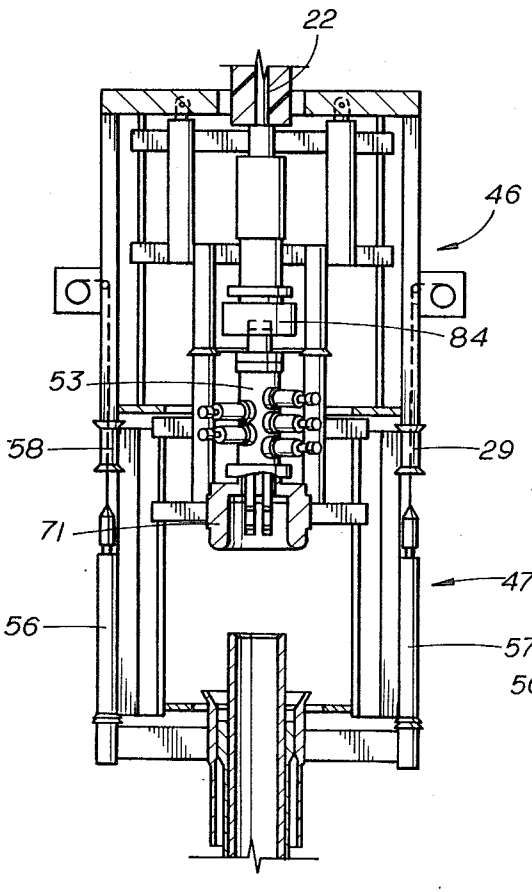
FIG. 12 is a view similar to FIG. 11, showing the equipment frame landed on the wellhead guide base.

FIG. 12 illustrates the upper and lower frame to be supported on the wellhead guide posts and the equipment to have been raised to its upper position. As the frame lands on the wellhead, the tension in the cables will shear pins 81. Further downward movement of the upper frame is prevented by the shoulder 78*a* on pipe 78, engaging the top of the guide 58 (FIG. 9A). A like shoulder may be provided on pipe 79. Shearing of pins 81 prevents the pins from interfering with emergency disconnect procedures. While shear pins are shown, it will be understood that latch pins or other means could be substituted which could be removed by the remote operated vehicle. After the wellhead is engaged by the frame, valve $V_1$ is reversed to raise the equipment. The pump 112 may be energized to provide additional force to raise the equipment to the FIG. 12 position. This provides slack in the riser pipe which no longer is supporting the equipment or the frame. At this time, additional pipe may be payed out from the vessel.

Figure 13:
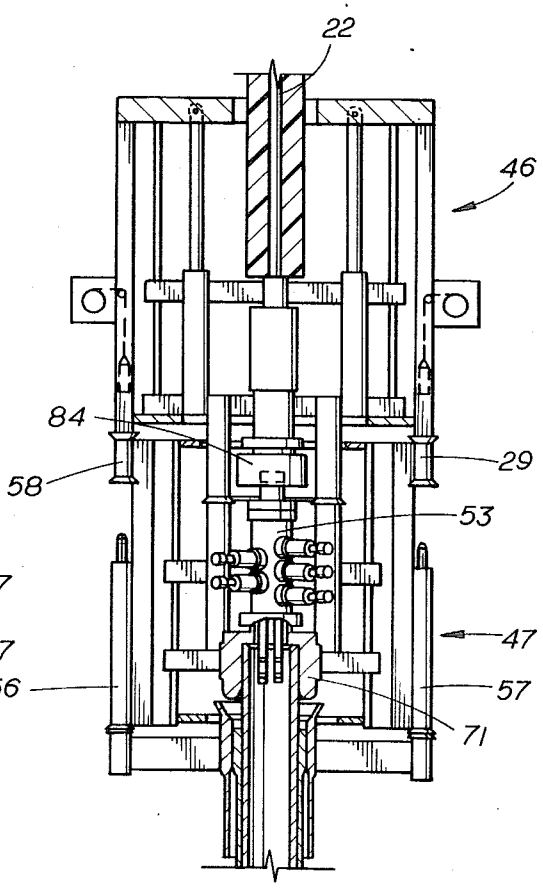
FIG. 13 is a view similar to FIG. 12, showing the christmas tree lowered and latched to the wellhead.

FIG. 13 illustrates downward movement of the equipment, resulting from returning valve $V_1$ (FIG. 18), to its original position to drive the equipment package, including the lower riser connector, downwardly so that the connector 71 on the lower end of the tree may connect to the wellhead. Either before or after moving the equipment package down, the cables may be disconnected from the wellhead and winched up into an out of the way position, as shown in FIG. 13. The well is produced with the equipment in the position shown in FIG. 13.

Figure 15:
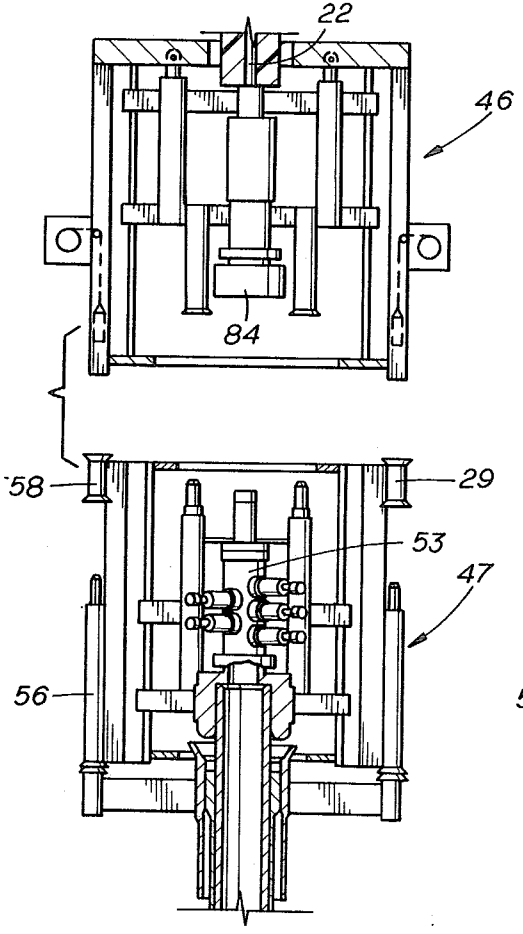
FIG. 15 is a view similar to FIG. 14, illustrating the upper frame released from the lower frame.

FIGS. 14 through 17 illustrate emergency disconnect and reconnect procedures. In the event that it is desired to disconnect the riser pipe from the equipment, valves are closed in the tree and the lower riser connector 84 is disconnected from the tree and moved upward to the upper portion of the upper frame. The disconnect package, which consists of the lower riser connector and the upper frame, may then be separated from and lifted off the lower frame, either by buoyancy, vessel manipulation of the riser, or other means, as shown in FIG. 15.

Figure 17:
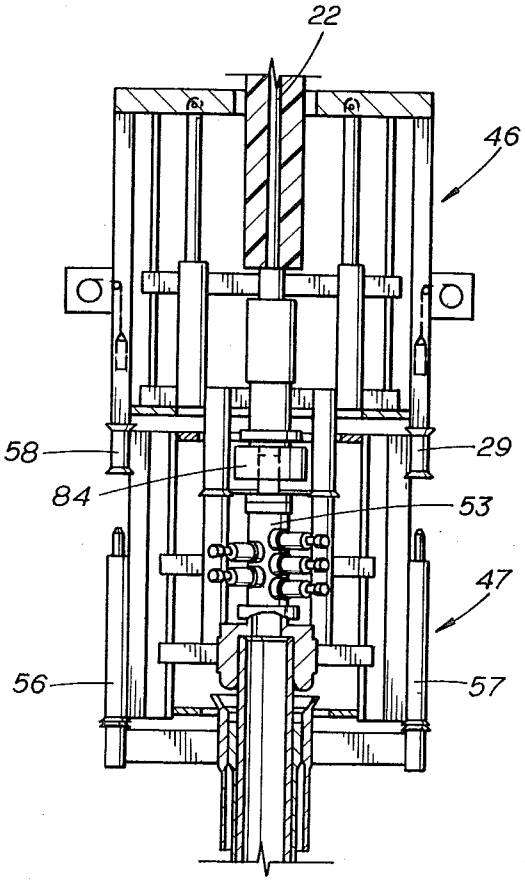
FIG. 17 is a view similar to FIG. 16, illustrating the reconnection of the lower riser connector with the christmas tree.
Figure 16:
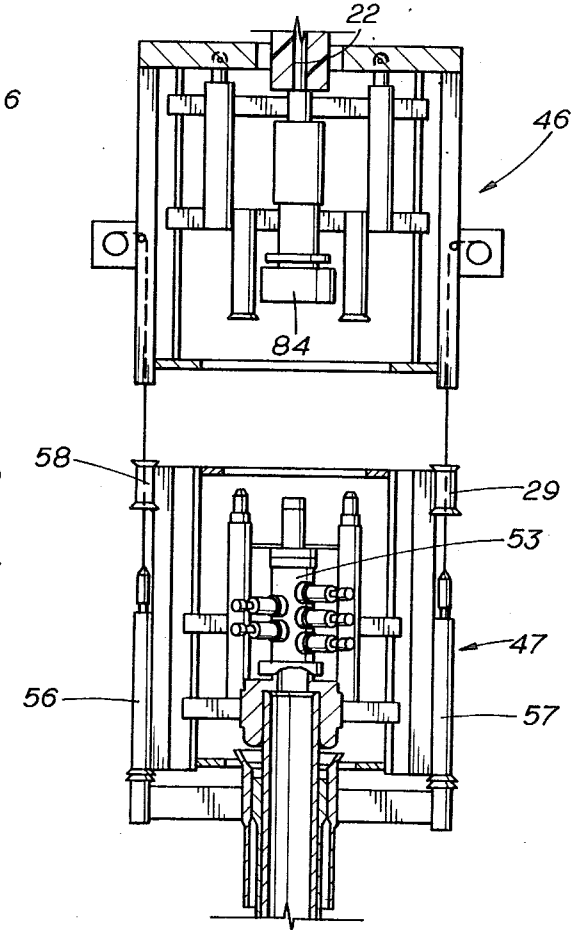
FIG. 16 is a view similar to FIG. 15, showing the cables reconnected to the wellhead guide posts and the upper frame and lower riser connector being drawn down to reposition the upper frame on the lower frame.

When it is desired to reconnect the upper and lower frames and the equipment, the draw down cables are extended through the upper guides 58 and 59, as shown in FIG. 16, and attached to the wellhead guides 56 and 57. The cables are then taken up to bring the upper frame back into engagement with the lower frame. If the package is very heavy, the heave compensation means may be utilized, if desired. After the frames are engaged, the hydraulic system is reversed by reversing valve $V_1$ to move the upper slide assembly downwardly and reengage the riser pipe lower connector 84 with the christmas tree, as shown in FIG. 17. After the frame sections are returned to the FIG. 17 position and the buoyancy means deactivated, the cables may again be released from the wellhead guides.

When it is desired to retrieve the christmas tree after an emergency disconnect has been carried out, the pins may be replaced between the upper and lower frame sections or the lower section may hang from the christmas tree. The tree is released from the wellhead. Raising the two slide assemblies to their intermediate position for acting as heave compensators while the cables are winched out and the riser pipe reel is taken in will result in the christmas tree moving upwardly with the lower riser connector. When the shear pins 81 are not replaced, the lower frame is supported from the tree. As the upper frame with its dependent christmas tree and lower slide assembly move upwardly as they are moved away from the well, the slide assembly will engage the upper plate 51 and the lower frame will be suspended from the lower slide assembly.

Figure 19:
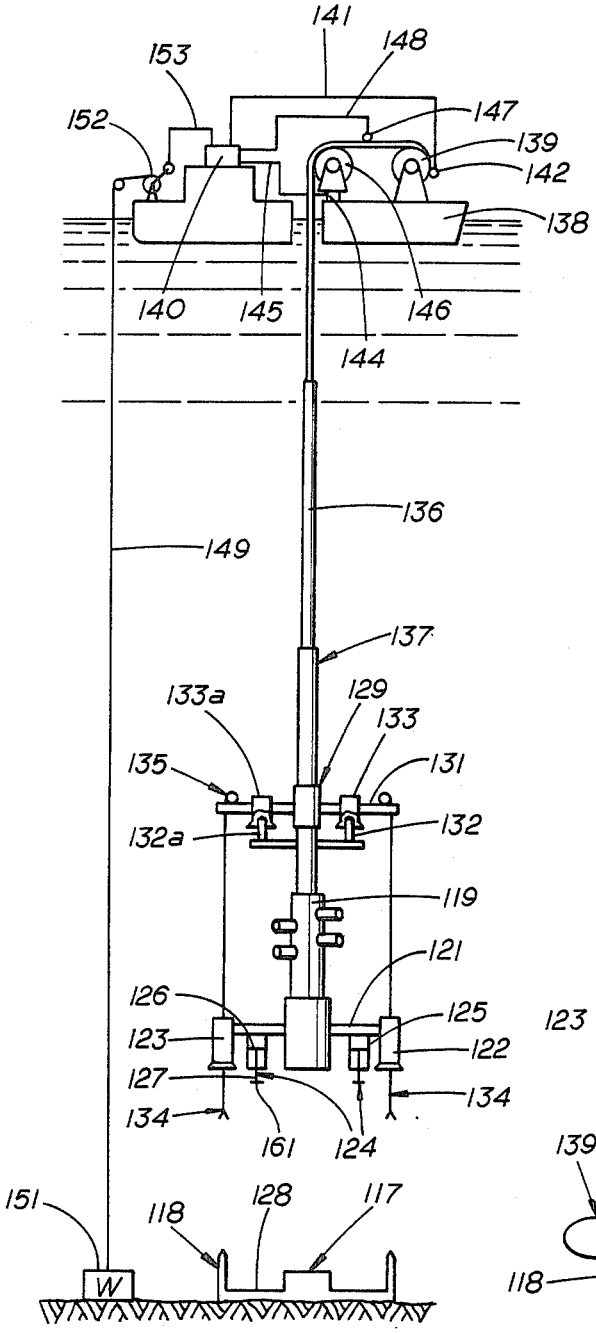
FIG. 19 is a diagrammatic view of a modified form of this invention.

FIG. 19 shows a modified form of the invention.

The wellhead 117 has upstanding guide posts 118.

The equipment to be landed includes the christmas tree 119 and its associated frame. The frame includes a lower frame member 121, having guides 122 and 123 thereon. The lower frame member also includes a plurality of soft landing motors 124 provided by cylinders 125 and pistons 126 depending from the frame member 121. Connecting rods 127 depend from the soft landing motors 124 and are engageable with the upwardly facing surface 128 of the wellhead during final landing of the equipment.

At the upper end of the tree 119 a disconnect system is shown, including the lower riser connector 129, which carries the upper frame member 131. Upwardly facing guides 132 and 132*a* are carried by the upper end of the tree 119 and cooperate with downwardly facing telescoping guides 133 and 133*a*, carried on the upper frame member 131.

Pull down cables 134 are carried on winches 135.

The equipment to be landed is suspended from the flexible riser pipe 136, which is provided with flotation 137.

At the surface, the vessel 138 carries the flexible riser pipe reel 139. The reel 139 may be hydraulic or electric and is controlled in the conventional manner to provide motion compensation between the vessel 138 and the suspended riser pipe 136 while the riser pipe is being payed out or taken in and during landing of the equipment. Preferably, motion compensation is provided between the riser pipe 136 and reel 139 during movement of the equipment between the surface and a position adjacent the wellhead where the cables 134 are attached or released from the guide post 118 by the diver or remote operated vehicle 139, as illustrated in FIG. 20.

Figure 20:
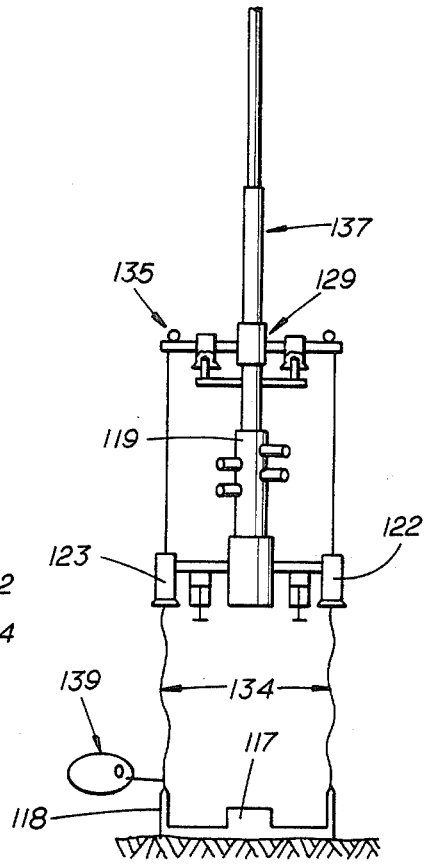
FIG. 20 is a diagrammatic view illustrating the draw down cables of the equipment shown in FIG. 19 being attached to the wellhead.

During movement of the equipment, between the position shown in FIG. 20 and the wellhead with the cables 134 attached, the reel 139 is controlled to maintain the cables 134 in tension while the equipment is being landed or released from the wellhead. The equipment may be maintained in tension by the motion compensation system if the heave of the vessel and the sophistication of the motion compensation system is such that the motion compensation system can maintain a substantially constant tension in cables 134.

It is preferred that control of the reel 139 be switched from motion compensation to tension form, in which a constant tension is maintained on the suspended riser pipe 136 as it moves under the influence of the pull down cables 134.

Equipment to control the reel 139 for both motion compensation and tensioning of the riser pipe 136 is well known. Preferably, the system includes a logic system 140 programmed to carry out the two desired functions by feeding an output through line 141 to the drive motor 142 for the reel 139. The logic system 140 will be fed all of the variable parameters needed to control the reel motor 142. A load cell 144 feeds load information to the logic system through line 145. This load cell is positioned between the vessel and idler pulley 146. An absolute shaft encoder 147 feeds information through line 148, such as the speed of movement of the flexible riser pipe and the elevation of the equipment. A tag line 149 from a weight 151 on bottom is carried by reel 152 and the elevation of the weight 151 is fed to the encoder through line 153. As will be understood by those skilled in the art, any additional information desirable to handle the equipment may be provided in the conventional manner.

In any of the systems illustrated and particularly in the system shown in FIG. 19, it is preferred that the winches, such as the winch 135, be controlled in such a manner that while they provide the constant tension needed to pull down the equipment, they also will permit slippage and accommodate some movement of the equipment as it is raised and lowered so that coordination of the operation of the pull down reels and the riser pipe reel need not be exact.

Figure 21:
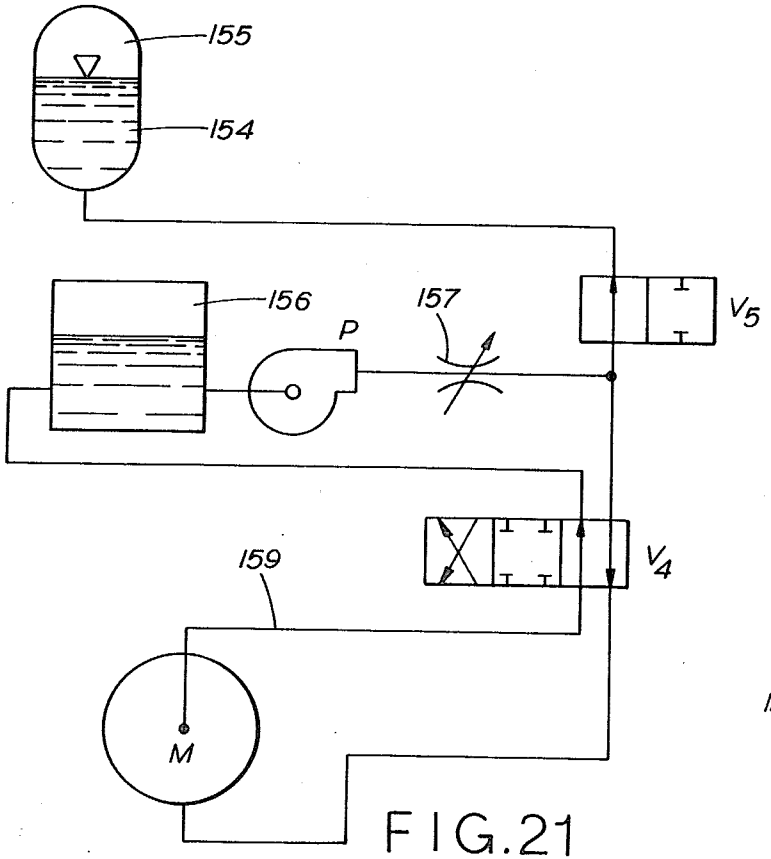
FIG. 21 is a schematic view of a control system for the draw down winches.

For the above purpose any type of slip arrangement may be utilized. For instance, as shown in FIG. 21, an accumulator 154, having a gas charge 155 in the upper end of the accumulator, may be provided in the drive circuit to the winch motor M. In this system, the pump P draws liquid from the reservoir 156 and charges the system through the control valve 157. The control valve 157 introduces fluid into the line 158, which is connected to the motor M and to the accumulator 154. Flow through the line 158 is controlled by valves $V_4$ and $V_5$. Return flow from the motor is provided through a line 159, which also is controlled by valve $V_4$ and connects the motor with the reservoir 156. The valve $V_5$ is a shut off valve to isolate the accumulator from the system and permit it to be used in other systems if desired. The valve $V_4$ provides also for shut off of fluid to the motor M and for a reverse flow, as illustrated, to provide for rotation of the winch motors M in both directions.

The adjustable valve 157 permits the operator to maintain any desired flow rate for driving the motor to maintain the desired tension on the system. The accumulator permits some overriding of the valve 157 to permit limited paying out and taking in of the cables by changing the liquid level in the accumulator 154.

A soft landing of the equipment, shown in FIG. 19, is accommodated by the soft landing motors 124. After the equipment is drawn down to the position where the connecting rods 127 engage the surface 128 of the wellhead, the equipment is held in spaced relation from the wellhead by the soft landing motors 124. At this time, the riser pipe reel is operated to reel out additional flexible pipe and final landing of the equipment is controlled by the cable winches and the soft landing motors 124. The soft landing motors 124 maintain the cables in tension as the equipment is moved into its final landing position, where the christmas tree may be connected to the wellhead.

Figure 22:
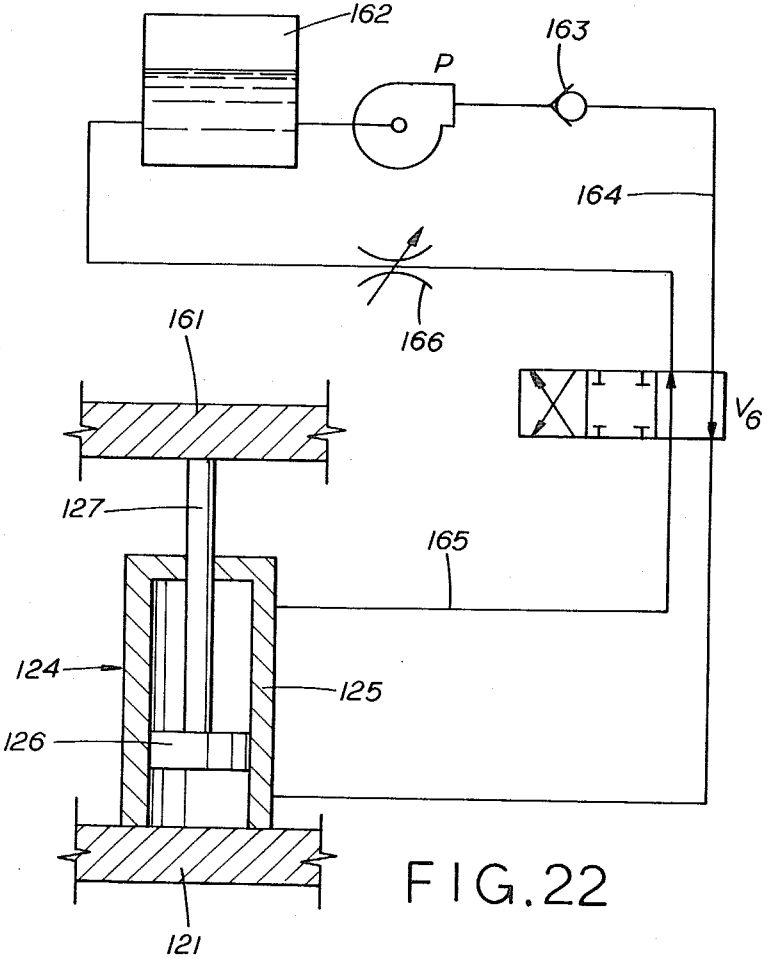
FIG. 22 is a schematic view of a control system for the soft landing pistons of FIG. 19.

A suitable control system for the motors 124 is illustrated in FIG. 22. The motors 124 are shown in inverted position in FIG. 22. The connecting rods 127 carry pads 161, which may be individual pads as shown in FIG. 19 or the pads may be provided by a circular ring connected to all of the motors 124. Fluid for operating the motors 124 is drawn from the reservoir 162 by pump P and injected into the system through the check valve 163, in line 164 which connects to the head end of the cylinder 125. The rod end of the cylinder 125 is connected through line 165 to the reservoir 162. A control valve $V_6$ provides for reverse flow to the motor 124 and for disconnection of the motor 124 from the fluid source. Control of flow of the fluid is provided by the control valve 166. With the valve $V_6$ in the position shown, the pump will force fluid into the head end of the cylinder to extend the landing pad 166 to its full extended position. Thereafter, the valve $V_6$ is moved to the reverse position and fluid is bled out of the head end of the motor 124 through the control valve 166, as the winches 135 take up the cables 134 and move the equipment to its fully landed position.

In operation of the system shown in FIG. 19, the equipment is lowered, preferably using motion compensation control of the riser pipe reel, until it reaches a position adjacent the wellhead 117, as shown in FIG. 19. At this time, the cables 134 are connected to the guide post 118 and placed in tension. Also, at this time, it is preferred that the drive motor for the riser pipe reel be switched to tension control to maintain a constant tension on the riser pipe to thus maintain the hold down cables 134 in tension. The operator then pays out the riser pipe and takes in the pull down cables simultaneously to move the equipment down to a position where it is held in standoff relationship by the soft land motors 124. At this time, the riser pipe 136 is reeled out to provide slack for final landing of the equipment by the cooperation of the pull down cables and the soft landing motors. The cable winches are now operated in conjunction with the soft landing motors to slowly reel in the cables while maintaining the cables in tension with the soft landing motors 124.

After the equipment is landed and latched in place, the cables are released from the guide post 118 and drawn in. The system is now in condition for emergency release if needed by releasing the riser pipe connector 129 and lifting off the connector and the upper frame 131 as by using buoyancy means disclosed hereinabove. As hereinabove disclosed, the riser pipe may be thereafter reconnected to the Christmas tree 119.

When the equipment is to be removed, the cables 134 are reattached to the guide post 118 and placed in tension. The control system shown in FIG. 22 is then operated to extend the pistons 126 to lift the unlatched equipment away from the wellhead. Thereafter, the riser pipe is placed in tension and taken in as the cables are paid out to move the equipment to a position for disengagement of the cables 134 and thereafter the equipment may be reeled into the surface. While the soft landing motors do not have to be used in disengaging the equipment, it is preferred that they be used so that control of disengagement of the equipment from the wellhead may be carried out by equipment acting between the blowout preventer and wellhead instead of the riser pipe, which might have some undesired movement which could possibly result in damage to the equipment.

While the system has been explained in conjunction with a christmas tree, it will be apparent that any other equipment could be landed on the wellhead utilizing the illustrated system and method as a motion compensator between the equipment and the wellhead and reciprocating the equipment relative to the wellhead for attaching or releasing equipment. For instance, blowout preventers, test trees and the like may readily be run and attached to the wellhead utilizing this invention.

The foregoing disclosure and description of the invention are illustrative and explanatory thereof and various changes in the method and system and in the size, shape and materials, as well as in the details of the illustrated construction, may be made within the scope of the amended claims without departing from the spirit of the invention.

What is claimed is:

1. A system for installing subsea devices comprising, wellhead means including a plurality of upwardly extending first guide means, equipment means to be landed including frame means having second guide menas cooperable with said first guide means to align said frame means with said wellhead means, a plurallity of draw down means carried by one of said frame means and said wellhead means and having means releasably attached to the other of said frame means and said wellhead means to draw said frame means and engage said first and second guide means, said equipment means includes upper and lower sections releasably secured together, said frame means includes upper and lower frame means, said lower frame means supports said lower equipment section, said upper equipment section slidably supported on said upper frame means, and yieldable urging means connected between said upper frame means and said upper equipment section and yieldably urges said frame means and said lower equipment means upwardly with a force at least equal to the downward force exerted by said frame means and said lower equipment means.

2. A system for installing subsea devices comprising, wellhead means including a plurality of upwardly extending first guide means, equipment means to be landed including frame means having second guide means cooperable with said first guide means to align said frame means with said wellhead means, a plurlaity of draw down means carried by one of said frame means and said wellhead means and having means releasably attached to the o ther of said frame means and said wellhead means to draw down said frame means and engage said first and second guide means, said draw down means provided by cable winch means carried by said frame means and cables releasbly attached to said fist guide menas and extending through said second guide means, said equipment means includes upper and lower sections releasablly secured together, said frame means includes upper and lower frame means, said lower frame means supports said lower equipment section, said upper equipment section slidably supported on said upper frame means, and yieldable urging means connected between said upper frame means and said upper equipment section and yieldably urges said frame means and said lower equipment means upwardly with a force at least equal to the downward force exerted by said frame means.

3. A system for installing subsea devices comprising, wellhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said equipment means includes upper and lower sections releasably secured together, said frame means includes upper and lower frame means, said lower frame means slidably supports said lower equipment section, said upper equipment section slidably supported on said upper frame means, and yieldable urging means connected between said upper frame means and said upper equipment section and yieldably urges said frame means upwardly with a force at least equal to the downward force exerted by said frame means.

4. A system for installing subsea devices comprising, wellhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said draw down means provided by cable winch means carried by said frame means and cables releasably attached to said first guide means and extending through said second guide means, said equipment means includes upper and lower sections releasably secured together, said frame means includes upper and lower frame means, said lower frame means slidably supports said lower equipment section, said uppwer equipment section slidably supported on said upper frame means, and yieldable urging means connected between said upper frame means and said upper equipment section and yieldably urges said frame means upwardly with a force at least equal to the downward force exerted by said frame means.

5. A system for installing subsea devices comprising, welllhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said equipment means slidably supported on said frame means, and yieldable urging means connected between said equipment means and said frame means urging said frame means upwardly with a force at least equal to the downward force exerted by aid frame means.

6. A system for installing subsea devices comprising, wellhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said draw down means provided by cable winch means carried by said frame means and cables releasably attached to said first guide means and extending through said second guide means, said equipment means slidably supported on said frame means, and yieldable urging means connected between said equipment means and said frame means urging said frame means upwardly with a force at least equal to the downward force exerted by said frame means.

7. The system of claim 1, 2, 3, 4, 5, or 6 wherein said equipment means is yieldably supported from above.

8. The system of claim 7 wherein said equipment means is supported from above by buoyancy means.

9. The system of claim 1, 2, 3, 4, 5, or 6 wherein a riser pipe connects said equipment means to a vessel on the surface of the water above said wellhead means.

10. The system of claim 1, 2, 3, 4, 5, or 6 wherein riser pipe means connects said equipment means to a vessel on the surface of the water above said wellhead means, and said yieldable urging means provides a motion compensator for the system.

11. The system of claim 10 wherein said riser pipe means is flexible.

12. The system of claim 1, 2, 3, 4, 5, or 6 wherein riser pipe means connects said equipment means to a vessel on the surface of the water above said wellhead means;

and said yieldable urging means is provided by piston means within cylinder means, and accumulator means in fluid communication with the cylinder means and exerting a constant upward force at least equal to said downward force while permitting said piston means to reciprocate in said cylinder means to provide motion compensation for said system.

13. The system of claim 12 wherein said riser pipe means is flexible.

14. The system of claim 12 wherein said accumulator is alternately connected to said cylinder means on opposite sides of said piston means through valve means which also alternately connects said cylinder means to a reservoir of fluid to provide for raising and lowering of said equipment means.

15. The system of claim 12 wherein said accumulator is alternately connected to said cylinder means on opposite sides of said piston means through valve means which alternately connects said cylinder means to a reservoir of fluid to provide for raising and lowering of said equipment means relative to said frame means.

16. A system for installing subsea devices comprising, wellhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said equipment means suspended from a flexible riser pipe, said riser pipe spooled on a reel supported at the surface by a vessel, and means on said vessel controls rotation of said reel to pay out and take in said riser pipe and provides motion compensation between said vessel and the suspended riser pipe while said draw down means are in tension.

17. The system of claim 16 wherein said draw down means is provided by cable winch means carried by said frame means and cables releasably attached to said first guide means and extend through said second guide means.

18. A system for installing subsea devices comprising, wellhead means including a plurality of upwardly extending first guide means, equipment means to be landed including frame means having second guide means cooperable with said first guide means to align said frame means with said wellhead means, a plurality of draw down means carried by one of said frame means and said wellhead means and having means releasably attached to the other of said frame means and said wellhead means to draw down said frame means and engage said first and second guide means, said equipment means suspended from a flexible riser pipe, said riser pipe spooled on a reel supported at the surface by a vessel, and means on said vessel controls rotation of said reel to pay out and take in said riser pipe and alternatively maintains said suspended riser pipe in tension while said draw down means are in tension and provide motion compensation between said vessel and the suspended riser pipe.

19. The system of claim 18 wherein said draw down means is provided by cable winch means carried by said frame means and cables releasably attached to said first guide means and extend through said second guide means.

20. The system of claim 16, 18, 17 or 19 wherein;

soft landing motor means are carried by said equipment means and extend downwardly and engage said wellhead means as said equipment means approaches said wellhead, said soft landing motor means controllably resisting movement of said equipment means toward said wellhead.

21. As a subcombination, subsea wellhead means carrying a plurality of upwardly extending first guide means, equipment means to be connected to said wellhead means including frame means having second guide menas cooperable with said first guide means to align said equipment frame means with said guide frame means, and double acting motor means connecting said frame means to the remainder of said equipment means for raising and lowering said equipment means relative to said frame means.

22. As a subcombination:

subsea wellhead means carrying a plurality of upwardly extending first guide means;

equipment means to be landed including frame means having second guide means on the lower end of said frame means cooperable with said first guide means to align said frame means with said first guide means;

said frame means including upper and lower frame means;

said equipment means including an upper equipment section slidably supported on said upper equipment frame means, said equipment means including a lower equipment section supported on said lower frame means, means releasably latching said upper and lower frame means together, means releasably latching said upper and lower equipment sections together, and double acting motor means connecting said upper equipment section to said upper frame means.

23. The subcombination of claim 22 wherein said lower equipment section is slidably carried on said lower frame means and releasable latching means are provided on the lower equipment section for attachment to said wellhead means.

24. The method of connecting equipment to a wellhead comprising, suspending an equipment frame from a flexible riser pipe carried on a reel on a vessel, positioning the equipment frame above the wellhead, attaching pull down cables between the equipment frame and wellhead, reeling in pull cables while paying out riser pipe from the vessel and landing said equipment frame on said wellhead, and while reeling in said cables, urging said equipment frame upwardly relative to said riser pipe by a force at least as great as the downward force exerted by said equipment frame in a motion compensator permitting relative movement between the riser pipe and equipment frame.

25. The method of claim 24 wherein;

equipment is supported on said riser pipe and is slidably carried by said equipment frame, after said equipment frame is landed, said equipment is supported by said frame and slack is provided in said riser pipe, and then said equipment is lowered into engagement with said wellhead.

26. The method of connecting equipment to a wellhead comprising, suspending an equipment frame from a flexible riser pipe carried on a reel on a vessel, positioning the equipment frame above the wellhead, attaching pull down cables between the equipment frame and wellhead, and reeling in the pull down cables while paying out riser pipe from the vessel and landing said equipment frame on said wellhead, and during lowering of said frame from the surface to said wellhead controlling rotation of said reel to provide motion compensation between said vessel and said frame.

27. The method of connecting equipment to a wellhead comprising, suspending an equipment frame from a flexible riser pipe carred on a reel on a vessel, positioning the equipment frame above the wellhead, attaching pull down cables between the equipment frame and wellhead, and reeling in the pull down cables while paying out riser pipe from the vessel and landing said equipment frame on said wellhead, and during lowering of said frame from the surface to a position adjacent said wellhead controlling rotation of said reel to provide motion compensation between said vessel and said suspended riser pipe until said cables are attached and therafter maintains said cables in tension until said frame is landed on said wellhead.

28. The method of connecting equipment to a wellhead comprising, suspending an equipment frame from a flexible riser pipe carried on a reel on a vessel, positioning the equipment frame above the wellhead, attaching pull down cables between the equipment frame and wellhead, and reeling in the pull down cables while paying out riser pipe from the vessel and landing said equipment frame on said wellhead, and controlling rotation of said reel to maintain said cables in tension while reeling in the pull down cable.

29. The method of claim 26, 27 or 28 wherein;

as the equipment approaches the wellhead soft landing motors engage said wellhead and support said equipment, said flexible riser is paid out and no longer supports said equipment, and said soft landing motors are operated to permit said equipment to be pulled down to full landed position by said pull down cables against the resistance of said soft landing motors.

30. The method of emergency disconnecting and reconnecting equipment to a wellhead comprising;

unlatching said equipment from the wellhead, providing buoyancy to said equipment in excess of the downward force exerted by said equipment to lift it from the wellhead, attaching pull down cables between said equipment and wellhead, reeling in said cables to reposition the equipment on the wellhead, and relatching the equipment to the wellhead.

31. The method of connecting equipment carried by a frame to a wellhead comprising;

suspending said equipment and frame from a flexible riser pipe carried on a reel on a vessel, positioning the frame and equipment above the wellhead, attaching pull down cables between the frame and wellhead, urging said frame upward relative to said riser pipe by a force at least equal to the downward force exerted by said frame in a motion compensator permitting relative movement between the riser pipe and the frame, reeling in the pull down cables while paying out riser pipe from the vessel and landing said frame on said wellhead with said equipment spaced from said wellhead, providing slack in said riser pipe, moving said equipment downward relative to the frame and into engagement with said wellhead, and latching said equipment to said wellhead.

32. The method of claim 31 wherein the equipment is moved downwardly relative to the frame by applying a downward force through said motion compensator.

33. The method of claim 31 wherein, after said equipment frame is landed on said wellhead said equipment is first moved upward relative to said frame to provide slack in said riser pipe, and additional riser pipe is then paid out from said reel prior to moving the equipment downward relative to the frame.

34. The method of disconnecting equipment and a flexible riser pipe from a subsea wellhead comprising, attaching pull down cables between the equipment and wellhead, urging said equipment upwardly relative to said riser pipe by a force at least as great as the downward force exerted by said equipment, removing slack from said riser pipe, reeling in said riser pipe while simultaneously paying out said pull down cables until the equipment is clear of the wellhead, detaching the cables between the equipment and wellhead, and reeling in the riser pipe to bring the equipment to the surface.

35. The method of disconnecting equipment and a flexible riser pipe from a subsea wellhead comprising, attaching pull down cables between the equipment and wellhead, maintaining said cables in tension while paying out said cables and reeling in said riser pipe until the equipment is clear of the wellhead, detaching the pull down cables, and reeling in the riser pipe to bring the equipment to the surface.

36. The method of claim 35 wherein said equipment is first lifted a preliminary distance before reeling in said riser pipe.

* * * * *

UNITED STATES PATENT AND TRADEMARK OFFICE

CERTIFICATE OF CORRECTION

PATENT NO. : 4,702,320

DATED : Oct. 27, 1987

INVENTOR(S) : Gano et al

It is certified that error appears in the above—identified patent and that said Letters Patent is hereby corrected as shown below:

Column 13, line 2, change "menas" to --means--.

Column 13, line 5, change "plurallity" to --plurality--.

Column 13, line 9, before "said" (1st occurrence) insert--down--.

Column 13, line 32, change "plurlaity" to --plurality--.

Column 13, line 34, change "o ther" to --other--.

Column 13, line 40, change "releasbly" to --releasably--; change "fist" to --first--; and change "menas" to --means--.

Column 13, line 43, change "releasablly" to --releasably--.

Column 13, line 55, after "means" insert --and said lower equipment means--.

Column 14, line 38, change "uppwer" to --upper--.

Column 14, line 63, change "aid" to --said--.

UNITED STATES PATENT AND TRADEMARK OFFICE

CERTIFICATE OF CORRECTION

PATENT NO. : 4,702,320

DATED : Oct. 27, 1987

INVENTOR(S) : Gano et al

It is certified that error appears in the above-identified patent and that said Letters Patent is hereby corrected as shown below:

Column 17, line 33, before "pul" insert --the--; before "cables" insert --down--.

Signed and Sealed this

Fourteenth Day of February, 1989

*Attest:*

*Attesting Officer*

DONALD J. QUIGG

*Commissioner of Patents and Trademarks*